United States Patent [19]

Wood et al.

[11] 4,244,583

[45] Jan. 13, 1981

[54] SELF SCORING TARGET FOR DARTS AND SIMILAR PROJECTILES

[76] Inventors: Eugene L. Wood, 265 Bradley Ave., State College, Pa. 16801; Alfred M. Cooke, Milton Farm, Reay, Caithness, Scotland

[21] Appl. No.: 875,741

[22] Filed: Feb. 6, 1978

[51] Int. Cl.[3] ..... F41J 3/02

[52] U.S. Cl. ..... 273/373; 273/DIG. 28

[58] Field of Search ..... 273/102.2 R, 102.2 A, 273/102.2 B, 102.2 S, DIG. 2, DIG. 4, DIG. 8, 371, 373–376, 403, 404; 340/323 R, 16 R

[56] References Cited

U.S. PATENT DOCUMENTS

| | | | |
|---|---|---|---|
| 2,535,255 | 12/1950 | Barnes | 273/102.2 S |
| 3,004,763 | 10/1961 | Knapp | 273/102.2 A |
| 3,101,198 | 8/1963 | Williams | 273/102.2 A |
| 3,112,110 | 11/1963 | Schulman | 273/102.2 A |
| 3,222,596 | 12/1965 | Meyer et al. | 273/102.2 A |
| 3,275,321 | 9/1966 | Forrest | 273/102.2 A |
| 3,341,204 | 9/1967 | McDannold | 273/102.2 A |
| 3,401,939 | 9/1968 | LaMura | 273/102.2 A |
| 3,585,497 | 6/1971 | Dalzell | 273/102.2 A |
| 3,705,725 | 12/1972 | Thalmann | 273/102.2 A |
| 3,778,059 | 12/1973 | Rohrbaugh et al. | 273/102.2 S |
| 3,854,722 | 12/1974 | Ohlund et al. | 273/102.2 A |
| 3,857,022 | 12/1974 | Rebane et al. | 273/102.2 S |
| 4,006,907 | 2/1977 | Heffley, Jr. | 273/102.2 S |
| 4,014,546 | 3/1977 | Steinkamp | 273/102.2 S |

*Primary Examiner*—Vance Y. Hum

*Attorney, Agent, or Firm*—Thomas E. Sterling

[57] ABSTRACT

This invention is an electronic device for detecting, remote indicating, and accumulation of multiple penetrations of a target by conductive shafts such as hand-thrown darts, metal-tipped arrows, or similar missiles. The device utilizes a target comprised of layers of conducting foam pads separated by thin insulating layers. When these foam pads are penetrated by a conducting shaft, they activate an electronic logic system which displays to the player the score that his dart has made on the target.

18 Claims, 14 Drawing Figures

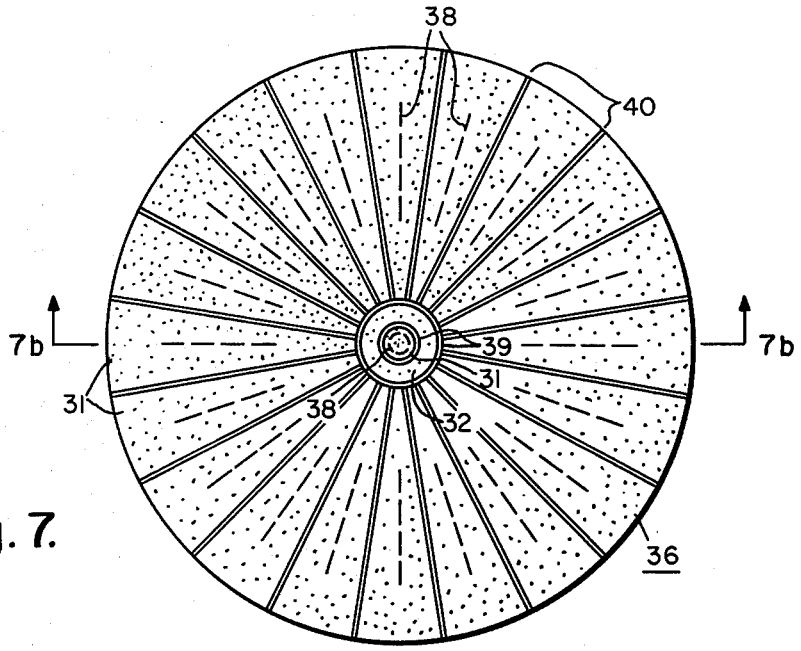
Fig. 7.
Fig. 7a.
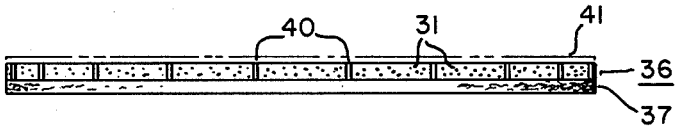
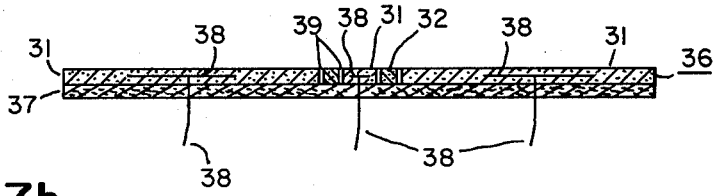
Fig. 7b.

SELF SCORING TARGET FOR DARTS AND SIMILAR PROJECTILES

PRIOR ART STATEMENT

The below-listed prior art of U.S. patents were obtained from a preliminary patent search conducted prior to the filing of this application, and includes what the inventors consider to be the closest art of which they are aware. The inventors are not withholding known prior art which they consider closer than that which is hereinafter listed:

| | |
|---|---|
| 2,629,599 | 3,401,939 |
| 2,837,336 | 3,454,277 |
| 2,693,959 | 3,580,579 |
| 3,101,198 | 3,585,497 |
| 3,112,110 | 3,705,725 |
| 3,275,321 | 3,854,722 |
| 3,341,204 | |

This invention relates to an improved method of detecting, indicating, and accumulation of scores of target sets commonly used for handthrown darts, archery and similar propelled missile games that do not completely penetrate the target set.

Essentially, in the present invention, there are multiple layers of conductive plastic foam with a high degree of elasticity, separated by thin penetrable insulating material such as silk, plastic, or close-woven, non-conducting fabric. The penetration of two or more layers of conductive plastic foam by a conductive shaft produces a relatively high resistance current path between the insulated layers. As one layer is electrically common to all scoring areas, this high resistance current path partially discharges a capacitor(s) which is normally kept charged through a resistor to a positive voltage source. This partial discharge results in a negative going pulse which is capacity coupled through to the inverting input of a high gain operational amplifier. As this pulse is capacity coupled, the resultant output of the operational amplifier is a positive pulse which will return to its nominal output level after the partially discharged capacitor reaches its new lower level. As this highly amplified pulse will have a high "noise" content as the conductive foam is being penetrated by the missile, the output pulse of the operational amplifier is fed to a "Schmidt-trigger" circuit for reshaping so as to have a sharp leading edge upon reaching a pre-set level. This reshaped pulse is then fed to a "one-shot" multivibrator which stretches the pulse to a length sufficient to overcome any following noise pulses created by the conductive shaft finally coming to rest. This pulse is now available for processing purposes of indication and/or accumulation. As a conductive shaft(s) through the conductive foam with its attendant high resistance path only partially discharges the capacitor(s), subsequent multiple penetrations serve only to reduce the capacitor(s) total charge further toward but never attaining zero. Each partial discharge will be capacity coupled and amplified by the operational amplifier and ultimately produce a pulse suitable for processing. Upon withdrawal of the conductive shafts, the capacitor(s) charge increases towards its nominal positive level. Although this increase is also capacity coupled to the operational amplifier, since it is fed to the inverting input, the output to the operational amplifier will be a negative-going signal which will already be below the triggering level of the following Schmidt-trigger circuit and thus there will be no output from said circuit or subsequent processing circuits.

An object of this invention is, therefore, to provide a target and scoring system which will automatically display the score which a particular dart or other missile has made on the target.

Another object of this invention is to provide a target scoring device that may be used with conventional metal-tipped darts, arrows, or similar missiles.

Still another object of this invention is to provide a target-indicating system which will reliably indicate a "hit".

Still another object of this invention is to provide a target-scoring device which will indicate the multiple detection of "hits" in the same scoring area without withdrawing previous missiles.

Still another object of this invention is to provide a target-scoring device that will permit the withdrawal of the missiles from the target without scoring or other accumulations.

Yet another object of this invention is to provide a target-scoring device having a "self-healing", reliable, and long-lived target set.

These and other objects of this invention will become clear by a reading of the following Specification and Claims in conjunction with the following drawings in which:

FIG. 7 shows a top representative view of the "bottom sensing layer" of a typical target set of FIG. 4.

FIG. 7A is a side view of the target of FIG. 7.

FIG. 7B is a cross-sectional view taken along line *7b—7b* of FIG. 7.

Figure 1:
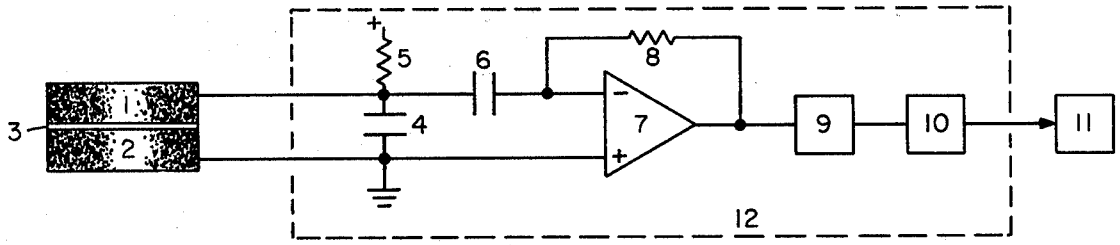
FIG. 1 is a simplified block diagram circuit showing the basic principles of operation of this invention.

Referring now to FIG. 1, "pads" 1 and 2 are constructed from conductive and elastic plastic foam and separated by a thin insulating layer 3. These pads 1 and 2 are connected across a capacitor 4 which is charged through resistor 5 from a positive source. Capacitor 6 couples the junction of capacitor 4 and resistor 5 to the inverting input of an operational amplifier 7. Resistor 8 from the output of the operational amplifier 7 to the inverting input of same, controls the overall gain or amplification of said operational amplifier 7. The output of the operational amplifier 7 is fed to a Schmidt-trigger 9, a level-sensitive snap-acting circuit for pulse shaping. The output of the Schmidt-trigger 9 is fed to a "one-shot" multivibrator 10 whose function is to stretch the output pulse for use in the processing circuits 11.

To summarize the operation of this basic circuit, a penetration of pads 1 and 2 and the thin insulating layer 3 by a conducting shaft of a dart will only partially discharge capacitor 4 due to the high relative resistance of the conductive foam pads 1 and 2. This sudden partial discharge of capacitor 4 creates a negative-going pulse which is coupled through capacitor 6 and subsequently amplified by the operational amplifier 7. This amplified pulse will have a high "noise" content as the conductive foam pads 1 and 2 are being penetrated which will be reshaped by the Schmidt-trigger 9 circuit so as to have a sharp leading edge upon reaching a pre-set level. The reshaped pulse is then stretched by the "one-shot" multivibrator 10 to a length sufficient to overcome any following noise pulses created by the conducting shaft finally coming to rest. This pulse is now available for processing purposes of indication and/or accumulation.

Figure 2:
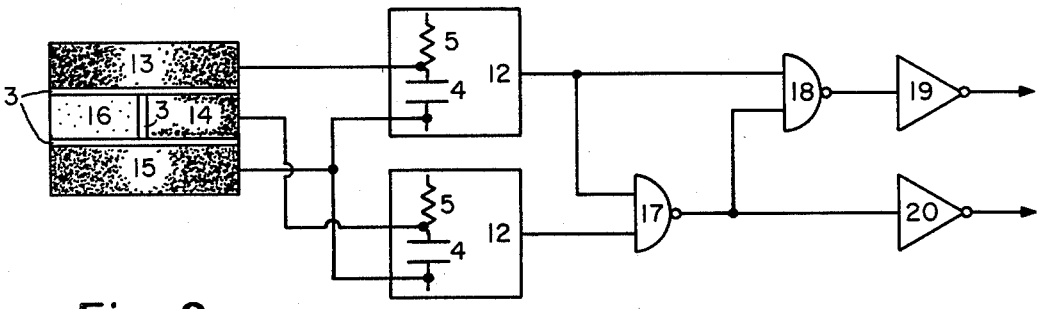
FIG. 2 is a slightly more elaborate block diagram of the basic simplified circuit showing how different "scoring areas" can be differentiated by multiple layers segregated by various non-conducting areas.

The entire circuitry enclosed by the dotted area 12 is redrawn in FIG. 2 as a symbolic block showing only capacitor 4 and resistor 5 and will be utilized as a constructional logic block for further operational descriptions.

Numerous conductive shafts can remain penetrating the conductive foam pads 1 and 2 and the circuit will still detect further penetrations as each shaft only reduces the available charge on capacitor 4 by a small amount. There are no output pulses developed when withdrawing the conductive shafts as each withdrawal of a conductive shaft serves only to increase the available charge on capacitor 4 which when capacity-coupled to the operational amplifier 7 will result in a negative-going output from same which will not trigger the Schmidt-trigger 9 and thus there will be no output from it.

The more elaborate circuit of FIG. 2 shows how numerous variations and quantities of the conductive foam pads could be utilized to make up a detector that is "area sensitive". The detector shown is comprised of conductive pad 13, 14 and 15 being constructed of conductive foam and separated from each other by a thin insulating layer 3. A portion of pads 13 and 15 are further separated by pad 16 which is of the same consistency foam but is non-conductive.

The constructional logic blocks 12 are, as previously stated, the dotted line area of FIG. 1. The addition of logic nand gates 17 and 18 and logic inverters 19 and 20 comprise the "area sensing" portion of the circuitry.

To summarize the operation of this basic circuitry, a penetration of the left side pads 13, 15 and 16 by a conductive dart shaft will first be described. This will result in a partial discharge of capacitor 4 in the upper constructional logic block 12 creating a high level stretched pulse from said constructional logic block. This high level, combined with the low level (no output) signal from the lower constructional logic block 12 results in a continuous high logic level output from nand gate 17. The high level from the upper constructional logic block 12 is further combined with the high level from nand gate 17 resulting in a low logic level output from nand gate 18. This low logic level is inverted to a high logic level by inverter 19 resulting in a "left side" processable signal for the duration of the high level stretched pulse from the upper constructional logic block. It will be noted there is no high output from inverter 20 due to the continuous high level from nand gate 17 on its input.

A penetration of pads 13, 14 and 15 on the right side of the detector assembly will create a partial discharge of capacitor 4 in both constructional logic blocks 12 resulting in a high level stretched pulse from both. These high logic levels combine at nand gate 17 resulting in a low logic level output from said gate. This low logic level is applied to inverter 20 resulting in a "right side" processable signal for the duration of the high level stretched pulses from both constructional logic blocks 12. It will be noted there is no high output from inverter 19 due to the low logic level at an input to nand gate 18 from nand gate 17 resulting in a high logic level from nand gate 18 being applied to the input of inverter 19.

Figure 3:
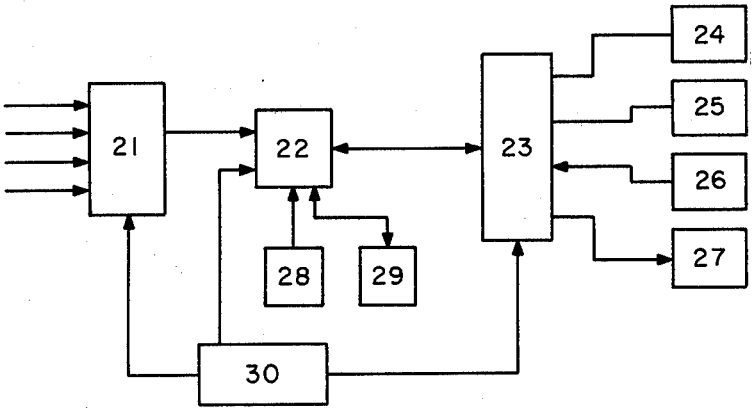
FIG. 3 is a detailed block diagram describing a typical complete function utilizing a number of inputs to produce a scoring indication on an assortment of indicators.

FIG. 3 describes a detailed scoring system combining a number of detector inputs similar to FIG. 2, processing the received data and producing an output on an assortment of indicators. In a typical situation it would be comprised of a multiplexing to sample "N" number of detector inputs; microprocessor 22 for data manipulation; interface 23 to couple the microprocessor 22 to peripheral equipment; peripherial equipment such as numerical displays 24, video display units 25, switches 26 or other peripheral equipment 27; read only memory 28 to contain the required operational microprocessor instructions; random access memory 29 to contain temporary values for the microprocessor and finally a timing generator 30 to synchronize all functional units that require same.

To summarize the operation of FIG. 3, the mulitplexer 21 scans all detector circuitry inputs one at a time under the control of the timing generator 30. Due to inherent pulse width variations of FIG. 2-type detector circuits, the scanning speed should be such that each detector input to the multiplexer 21 shall be sampled at least twice during the time frame of the shortest "stretched pulse".

The microprocessor 22 is under control of the timing generator 30 and performs various instructions permanently programmed in the read only memory 28 and stores intermediate calculated value in the random access memory 29. Upon receipt of two consecutive samples of valid detector data from the multiplexer 21 it processes it according to programmed instructions to or from the peripheral equipment 24, 25, 26 and 27 and/or random access memory 29 for temporary storage.

FIGS. 4, 4A, 4B, 5, 5A, 5B, 6, 6A, 7, 7A and 7B describe in detail a typical remotely-indicating target set. A simple dart board pattern is shown for this description and can be utilized with circuitry as described in FIGS. 2 and 3 to form a completely automatic indicating game set.

Figure 4:
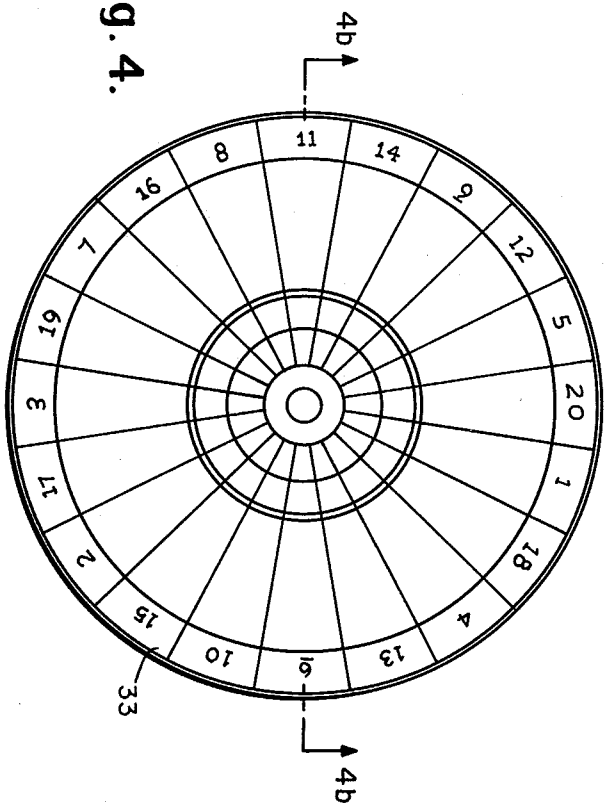
FIG. 4 is a top view of a typical dart target set showing the scoring areas thereon.
Figure 4A:
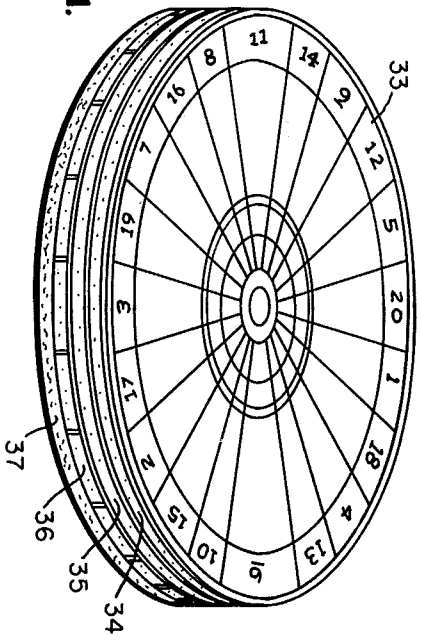
FIG. 4A is a perspective view of the target of FIG. 4.
Figure 4B:
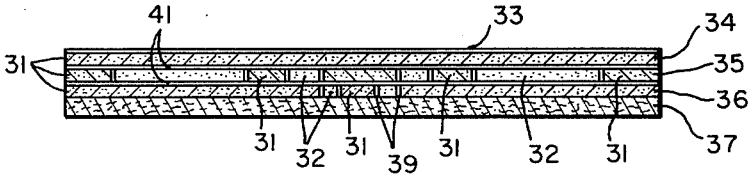
FIG. 4B is a cross-sectional view of the target of FIG. 4 and taken through the center.

The target assembly as FIG. 4 depicts shows a target sectioned off into 82 separate scoring divisions comprised on wedges, sections of circles, circles, and a center spot. The perspective view of FIG. 4A shows that it is of a sandwich style construction of a number of layers. The cross-section view 4C taken through the center of the target show in more detail its construction using both conducting 31 and non-conducting 32 plastic foam. The target surface has a thin penetrable target pattern 33 printed and bonded to the top sensing layer 34, center sensing layer 35, bottom sensing layer 36 and a fibrous backing board 37.

Figure 5:
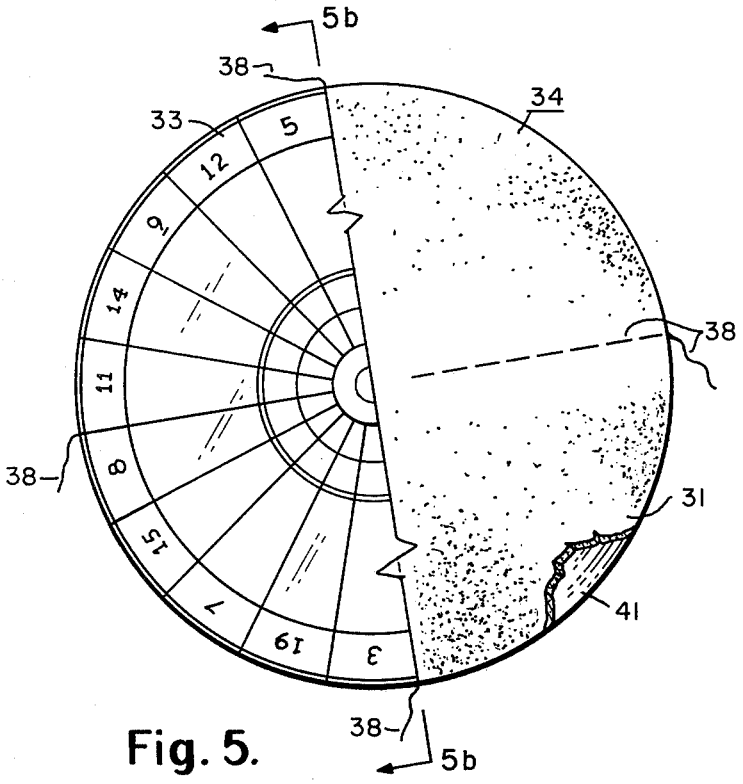
FIG. 5 is a top view of the target of FIG. 4 exposing the top sensing layer of half the target.
Figure 5A:
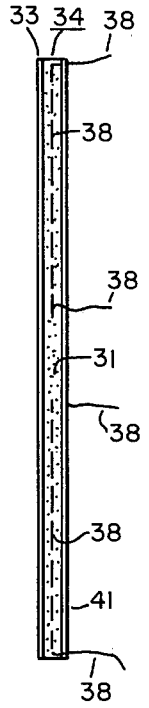
FIG. 5A is a side view of the target of FIG. 5.
Figure 5B:
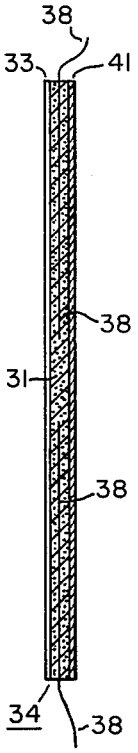
FIG. 5B is a cross-sectional view taken along line *5b—5b* of FIG. 5.

FIG. 5 gives greater detail to the top sensing layer 34. It will be noted that there are four wires (bare) 38 imbedded in a solid disc of conducting plastic foam 31. This disc has a thin penetrable target pattern 33 bonded to its top surface manufactured of silk, plastic, or man-made close-woven fabric. The side view 5A shows little additional except the bonded pattern 33 on the conductive foam disc 31 and trailing connecting wires 38. The cross-section view 5B again shows the pattern 33 and in addition shows the relative position of the imbedded wires 38.

Figure 6:
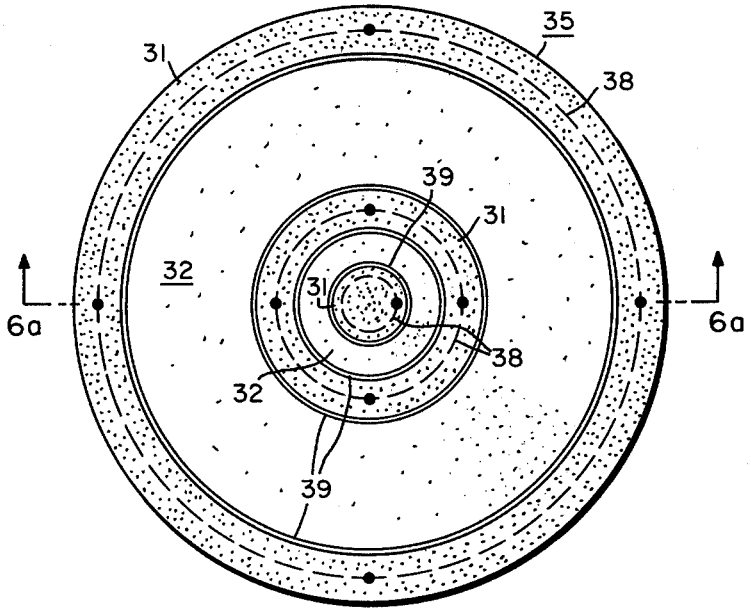
FIG. 6 shows a representative top view of the "center sensing layer" of a typical target set of FIG. 4.
Figure 6A:
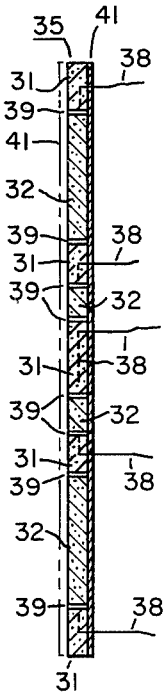
FIG. 6A is a cross-sectional view of the target of FIG. 6 taken through the center.

FIG. 6 gives greater detail to the center sensing layer 35. It is comprised of two rings and one plug of conductive foam 31 inset into two rings of non-conductive foam 32. The imbedded bare wires 38 are shown as dotted lines through the conducting foam 31. The side view shows little but a thin penetrable insulating surface 41 manufactured of silk, plastic, or man-made fabric bonded to the overall surface of the composite layer. The cross-sectional view 6A shows in detail the insulating rings 39 manufactured from hard plastic or other non-conducting material that prevents the conductive shafts of the darts from penetrating laterally from a conducting foam area to a non-conducting foam and vice versa.

FIG. 7 gives greater detail to the bottom sensing layer 36. It shows the twenty conductive foam 31 segments isolated from each other by hard plastic or other non-conducting material strips 40. In addition, there is a plug of conducting foam in the center of the layer surrounded by insulating rings 39 and a circle of non-conducting foam 32. The function of the hard non-conducting strips 40 and insulating rings 39 are the same as for FIG. 6 and prevent the conductive shafts of the darts from penetrating laterally from a conducting foam 31 area to a non-conductive foam 32 area and vice versa. An additional function of the hard non-conducting strips 40 is to keep separate electrically the conductive foam 31 segments. The side view 7A shows the butt ends of the conducting foam 31 and their separating hard non-conducting strips 40 and the thin penetrable insulating surface 41 manufactured of silk, plastic, or man-made fabric bonded to the overall surface of the composite layer. The cross-section view 7B shows the relative location of the insulating rings.

In summary of the typical remotely-indicating target set of FIGS. 4, 5, 6 and 7 and to relate it to FIGS. 2 and 3, the top sensing layer 34 is equivalent to the conducting foam pad 15 of FIG. 2 and the center sensing layer 35, along with the bottom sensing layer 36, would relate to multiple areas of conducting and non-conducting foam pads similar to pads 13, 14 and 16 of FIG. 2.

It will be noted that due to the unique sandwich construction and the described electronic detection scheme of "hit" areas, the amount of active sensing elements required to detect the 82 separate scoring zones of a typical dart board is reduced to only 25 elements. A 70% reduction in complexity of intraelement wiring alone is achieved.

The output wires 38 are connected to the multiplexing device 21 of FIG. 3, as a detector input, and processed as previously described. A display panel is positioned near the players which indicates accumulative totals for individuals or teams. A number of scoring methods may be introduced to reconfigure the microprocessor 22 by different read-only memories 28.

Although the invention has been described with a degree of particularity, numerous changes and modifications may be made without departing from the spirit of the invention.

We claim:

1. A target adapted to provide electrical signals when engaged by an electrically conductive missile, comprising (a) first and second adjacent spaced pads each formed of electrically conductive synthetic plastic foam material;

(b) means for electrically insulating the pads from each other;

(c) means for establishing a potential difference between said pads, said potential difference establishing means including (1) a capacitor having a pair of terminals connected with said pads, respectively; and (2) means applying across said capacitor a direct-current potential difference of such magnitude that upon penetration of said insulating means by a first conductive missile to electrically connect said pads, only partial discharge of said capacitor is produced; and (d) means including an operational amplifier having a pair of input terminals connected with said capacitor terminals, respectively, for producing a first electrical signal indicative of the resulting partial discharge of said capacitor, whereby subsequent penetrations of the target by a subsequent conductive missile produces further partial discharge of the capacitor, thereby affording the multiple detection of hits in the same scoring area.

2. Apparatus as defined in claim 1, and further including (e) a third pad (14) of electrically conductive synthetic plastic foam material extending only partially between said first and second pads;

(f) means electrically insulating said second and third pads;

(g) means including a second capacitor (4) connected across said second and third pads for establishing a potential difference between said second and third pads; and (h) means operable when a conductive missile penetrates said insulating means to electrically connect said second and third pads for producing a second electrical signal indicative of the resulting partial discharge of said second capacitor.

3. Apparatus as defined in claim 2, wherein the polarity of the direct-current potential means is such that the more positive terminal of the capacitor is connected with the inverting input of the amplifier, and the more negative terminal of the capacitor is connected with the non-inverting input of the amplifier.

4. Apparatus as defined in claim 3, and further including Schmidt trigger means connected with the output of the said amplifier, and monostable means connected with the output of said Schmidt trigger means.

5. Apparatus as defined in claim 4, and further including a pad of non-conductive plastic foam material arranged between said first and second pads remote from said third pad.

6. Apparatus as defined in claim 5, wherein said third pad and said non-conductive pad are separated by a relatively rigid member of electrically insulating plastic material.

7. Apparatus as defined in claim 1, wherein said insulating means include layers of insulation arranged between said electrically conductive pads of plastic foam material.

8. Apparatus as defined in claim 7, wherein said insulating layers comprise a fabric.

9. Apparatus as defined in claim 8, wherein said fabric is silk.

10. Apparatus as defined in claim 7, wherein said layers comprise a synthetic plastic material.

11. A target adapted to provide electrical signals when engaged by an electrically conductive missile, comprising (a) first, second and third superimposed, adjacent spaced layers, said first layer comprising a sheet of electrically conductive synthetic plastic foam material, said second layer comprising a plurality of pads of electrically conductive and non-conductive synthetic plastic foam material, respectively, arranged in a first predetermined pattern, and the third layer comprising pads of electrically conductive material arranged in a different predetermined pattern;

(b) means for establishing potential differences between the conductive pads of different layers, said potential difference establishing means including (1) a capacitor having a pair of terminals connected with said pads, respectively; and (2) means applying a direct-current potential difference across said capacitor;

(c) means operable when a first conductive missile electrically connects the conductive pads of two of said layers for producing a first electrical signal indicative of the resulting partial discharge of said capacitor; and (d) means for indicating the position on the target that a missile has impacted therewith, including a microprocessor, a multiplexer connecting said signal producing means with said multiplexer, a read-only memory connected to the microprocessor, a random access memory connected to the microprocessor, a timing generator connected to the multiplexing device, an interface connected to said microprocessor and said timing generator, and a visual display means connected to the interface and arranged to display a signal indicative of the position on the target that a missile has impacted therewith.

12. Apparatus as defined in claim 11, wherein said layers have a circular periphery, said third layer including first and second central annular pads of electrically conductive synthetic plastic foam material surrounded by a plurality of radially extending pads of said conductive material, and said second layer comprises alternate concentric annular pads of said conductive and non-conductive synthetic plastic foam material.

13. Apparatus as defined in claim 12, and further including a target face formed in said first layer, the boundaries of the pads of said second and third layers conforming to boundaries of different regions marked on said target face.

14. Apparatus as defined in claim 13, and further including means connected with said contact means and responsive to change in conductivity between said pads produced by a missile entering the layers, and an electrically conductive pad arranged between certain ones of the pads.

15. An electronic scoring target adapted to operate an electronic processing system upon the penetration thereof by an electrical conductive shaft, comprising, in combination:

(a) a target face;

(b) a top sending layer adjacent said target face;

(c) a center sensing layer adjacent said top sensing layer, said center sensing layer including, in combination:

(1) conducting center foam pads of corresponding pattern to a portion of said target face;

(2) non-conducting center foam pads positioned adjacent said conducting center foam pads and of corresponding pattern to a portion of said target face;

(3) a thin electrical insulating layer, comprised of silk, arranged between said conducting and non-conducting center foam pads, respectively; and (4) connecting wires imbedded in said conducting center foam pads for connection with the electronic processing system; and (d) a bottom sensing layer adjacent said center sensing layer, said bottom sensing layer including, in combination:

(1) conducting bottom foam pads of corresponding pattern to a portion of said target face;

(2) non-conducting bottom foam pads positioned adjacent said conducting bottom foam pads and of a corresponding pattern to a portion of said target face;

(3) a thin electrical insulating layer, comprised of silk, positioned between said conducting and said non-conducting bottom foam pads, respectively; and (4) connecting wires imbedded in said conducting bottom foam pad for connection with said electronic processing system.

16. An electronic scoring target system adapted to operate upon penetration by an electrically conductive shaft, comprising, in combination:

(a) a target face;

(b) a top sensing layer adjacent said target face;

(c) a center sensing layer adjacent said top sensing layer, said center sensing layer including, in combination:

(1) conducting center foam pads of corresponding pattern to a portion of said target face;

(2) non-conducting center foam pads positioned adjacent said conducting foam pads and of correponding pattern to a portion of said target face;

(3) a thin electrical insulating layer arranged between conducting center foam pads and non-conducting center foam pads; and (4) center connecting wires imbedded in said conducting center foam pads;

(d) an electronic processing system connected to said connecting wires, said electronic processing system including, in combination:

(1) a multiplexing device to which said connecting wires are attached;

(2) a microprocessor connected to said multiplexing device;

(3) a read-only memory attached to said microprocessor;

(4) a random access memory connected to said microprocessor;

(5) a timing generator connected to said multiplexing device;

(6) an interface connected to said microprocessor and to said timing generator;

(7) display means connected to said interface for displaying the score of said target; and (e) a bottom sensing layer adjacent said center sensing layer, said bottom sensing layer including, in combination:
(1) conducting bottom foam pads of corresponding pattern to a portion of said target face;
(2) non-conducting bottom foam pads positioned adjacent said conducting foam pads and of a corresponding pattern to a portion of said target face;
(3) a thin electrical insulating layer positioned between said conducting and said non-conducting bottom foam pads, respectively; and
(4) bottom connecting wires imbedded in said conducting bottom foam pads and connected to said electronic processing system.

17. The combination as claimed in claim 14, wherein said display means includes a video display unit.

18. An electronic scoring target adapted to operate upon the penetration of an electrical conductive shaft, comprising, in combination:
(a) a target face;
(b) a top sensing layer adjacent said target face;
(c) a center sensing layer adjacent said top sensing layer, said center sensing layer comprising, in combination:
(1) conducting center foam pads of corresponding pattern to a portion of said target face;
(2) non-conducting center foam pads positioned adjacent said conducting foam pads and of corresponding pattern to a portion of said target face;
(3) a thin electrical insulating layer, formed of synthetic plastic material, arranged between said conducting and non-conducting foam pads, respectively; and
(4) connecting wires imbedded in said conducting center foam pads for connection with an electronic processing system; and
(d) a bottom sensing layer adjacent said center sensing layer, said bottom sensing layer comprising, in combination:
(1) conducting bottom foam pads of corresponding pattern to a portion of said target face;
(2) non-conducting bottom foam pads positioned adjacent said conducting bottom foam pads and of a corresponding pattern to a portion of said target face;
(3) a thin electrical insulating layer, formed of of synthetic plastic material, arranged between said conducting and non-conducting foam pads, respectively; and
(4) connecting wires imbedded in said conducting foam pad for connection with said electronic processing system.

* * * * *